US007642883B2

(12) United States Patent
Kuylenstierna et al.

(10) Patent No.: US 7,642,883 B2
(45) Date of Patent: Jan. 5, 2010

(54) TUNEABLE FERROELECTRIC DELAY LINE HAVING MIRROR IMAGE CONDUCTORS

(75) Inventors: Dan Kuylenstierna, Göteborg (SE); Harald Jacobsson, Västra Frölunda (SE); Thomas Lewin, Onsala (SE); Spartak Gevorgian, Göteborg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 229 days.

(21) Appl. No.: 10/586,139

(22) PCT Filed: Mar. 9, 2004

(86) PCT No.: PCT/SE2004/000329

§ 371 (c)(1),
(2), (4) Date: Jul. 17, 2006

(87) PCT Pub. No.: WO2005/086276

PCT Pub. Date: Sep. 15, 2005

(65) Prior Publication Data

US 2007/0159271 A1 Jul. 12, 2007

(51) Int. Cl.
*H01P 1/18* (2006.01)

(52) U.S. Cl. ..... 333/161

(58) Field of Classification Search ..... 333/156, 333/161, 99 S

See application file for complete search history.

(56) References Cited

U.S. PATENT DOCUMENTS

| | | | | |
|---|---|---|---|---|
| 4,641,113 | A * | 2/1987 | Ozawa | 333/161 |
| 5,815,050 | A | 9/1998 | Brooks et al. | |
| 6,029,075 | A | 2/2000 | Das | |
| 6,076,001 | A | 6/2000 | Das | |
| 6,498,549 | B1 * | 12/2002 | Jiang et al. | 333/202 |
| 2002/0051334 | A1 | 5/2002 | Zhu et al. | |
| 2003/0025573 | A1 * | 2/2003 | Pchelnikov et al. | 333/161 |

FOREIGN PATENT DOCUMENTS

| | | |
|---|---|---|
| GB | 2042812 | 9/1980 |
| JP | A S61-262316 | 11/1986 |
| JP | A S59-202702 | 11/1987 |
| WO | WO 03/100903 | 4/2003 |

OTHER PUBLICATIONS

International Search Report for PCT/SE2004/000329 dated Oct. 18, 2004.
Translation of Chinese official action, Apr. 10, 2009, in corresponding Chinese Application No. 200480042321.2.
Summary of Japanese official action, Apr. 10, 2009, in corresponding Japanese Application No. 2007-502749.

* cited by examiner

*Primary Examiner*—Benny Lee
(74) *Attorney, Agent, or Firm*—Nixon & Vanderhye P.C.

(57) ABSTRACT

A tunable electromagnetic delay line, comprising a first conductor with a first main direction of extension. The first conductor is arranged on top of a non-conducting substrate. The delay line additionally comprises a layer of a ferroelectric material with first and second main surfaces. The layer separates the first conductor and the substrate. The delay line also comprises a second conductor with a second main direction of extension, with the first and second main directions of extensions essentially coinciding with each other, and with the first and second conductors being each other's mirror image with respect to an imagined line in the center of the delay line along the first and second main directions of extension. The tuning is accomplished by applying a voltage between said first and second conductors.

6 Claims, 12 Drawing Sheets

TUNEABLE FERROELECTRIC DELAY LINE HAVING MIRROR IMAGE CONDUCTORS

This application is the US national phase of international application PCT/SE2004/000329 filed 9 Mar. 2004, which designated the U.S., the entire content of which is hereby incorporated by reference.

TECHNICAL FIELD

The present invention relates to a tunable electromagnetic delay line.

BACKGROUND

Delay lines are a common component in many contemporary electrical systems, usually microwave systems. Examples that could be mentioned of fields of technology where delay lines are used are radar systems, amplifiers and oscillators.

Most technologies used in delay lines result in bulky components, which are usually not cost-effective and are difficult to integrate with standard semiconductor technologies. Moreover, it is quite desirable for a delay line to be tunable, i.e., to have a delay time which can be altered. In addition, most contemporary tunable delay lines are quite power consuming, which is usually a drawback.

SUMMARY

Hence, as described above, there is a need for a tunable delay line which is of a small size, has low power consumption, and capable of having long delay times.

This need is met by the technology in this application. A tunable electromagnetic delay line comprises a first conductor with a first main direction of extension. The first conductor is arranged on top of a non-conducting substrate.

The delay line additionally comprises a layer of a ferroelectric material with first and second main surfaces, which layer separates the first conductor and the substrate. The delay line also comprises a second conductor with a second main direction of extension.

The first and second main directions of extensions essentially coincide with each other, and the first and second conductors are each other's mirror image with respect to an imaginary line in the center of the delay line along the first and second main directions of extension. The tuning of the delay line is accomplished by applying a voltage between first and second conductors.

The advantages afforded by this design will become evident in the detailed description given below.

DETAILED DESCRIPTION

Figure 1:
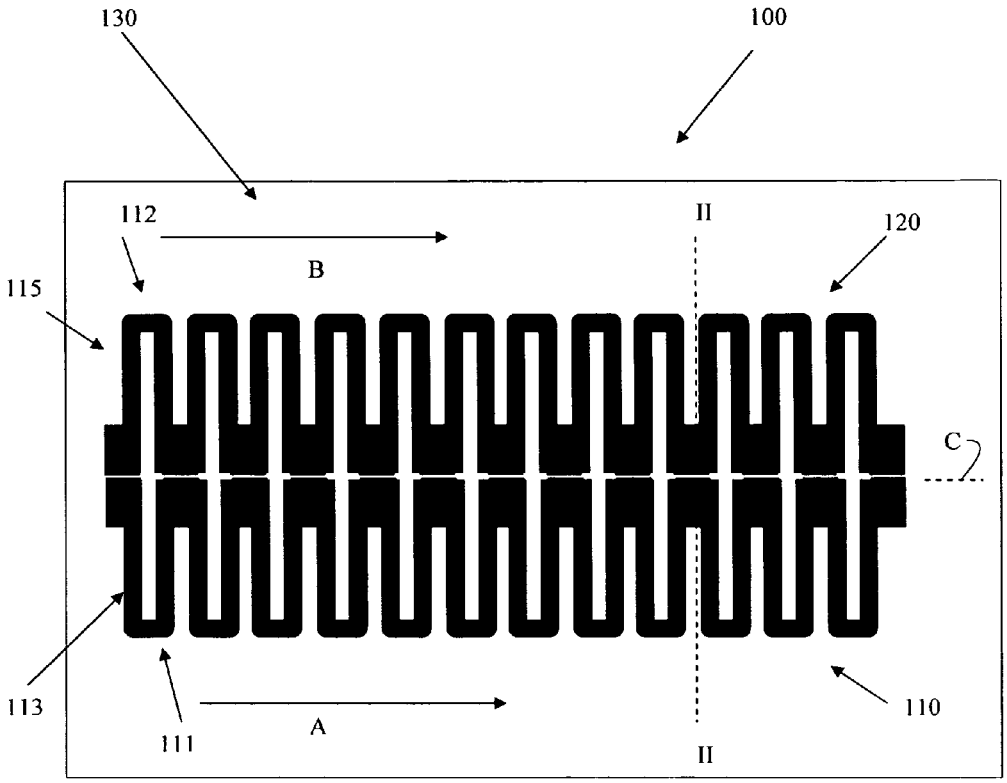
FIG. 1 shows a top view of a first non-limiting example embodiment

In FIG. 1, a first non-limiting example embodiment 100 of a tunable delay line is shown in top view. The delay line 100 comprises a first conductor 110, which has a first main direction of extension, indicated by the arrow A in FIG. 1. In addition to the first conductor 110, the delay line 100 also comprises a second conductor 120, which has a second main direction of extension, indicated by the arrow B in FIG. 1.

Figure 2:
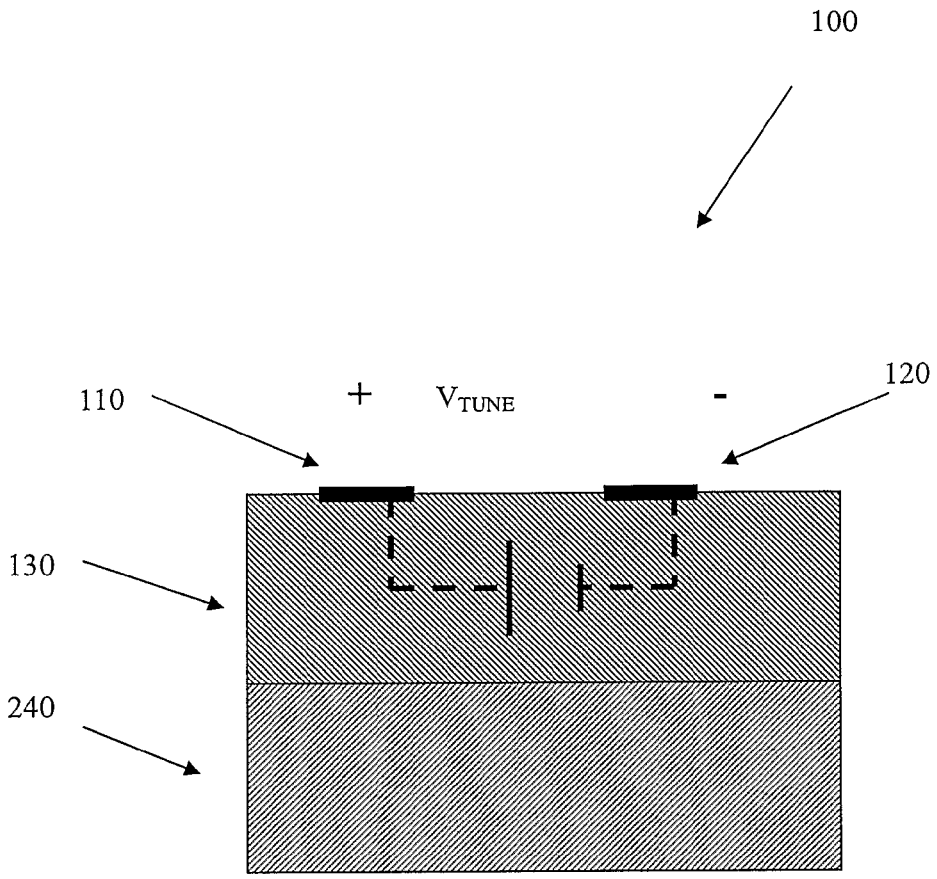
FIG. 2 shows a cross section of the device of FIG. 1, along the line II-II.

Shifting now to FIG. 2, a cross section of the arrangement 100 from FIG. 1 is shown, along the line II-II in FIG. 1. As can be seen in FIGS. 1 and 2, the first and the second conductors 110, 120 are arranged on top of a layer 130 of a ferroelectric material which has a high permittivity. Some examples of such materials are $BaTiO_3$, $SrTiO_3$ and various combinations of Ba, Sr and $TiO_3$, usually expressed as $Ba_xSr_{(1-x)}TiO_3$ or combinations of Na, K and $NO_3$, usually expressed as $Na_x K_{(1-x)}No_3$.

Below the layer 130 of the ferroelectric material, there is arranged a supporting layer or substrate 240 of a non-conducting material. In FIG. 2, there is also schematically shown how the delay $\tau$ of the device 100 is altered: an AC control voltage, $V_{TUNE}$, is applied between the first and second conductors 110, 120, and the voltage is altered to achieve the desired delay $\tau$. The (+) and (−) symbols indicate the polarity of $V_{TUNE}$ when applied. Also indicated in FIG. 2 with broken lines, is the fact that there is a capacitive coupling between the two conductors 110, 120.

Returning now to FIG. 1, it can be seen that in the delay line 100, the first main direction of extension, A, of the first conductor 110 essentially coincides with the second main direction of extension, B, of the second conductor 120, and also that the first 110 and second 120 conductors are mirror images with respect to an imaginary line C in the center of the delay line, along the first and second main directions of extension.

Preferably, as can also be seen in FIG. 1, the first conductor 110 is meander shaped, and is comprised alternatingly of sections 111 with a second direction of extension, and sections 113 with a third direction of extension. The second conductor 120 is comprised alternatingly of sections 112 with a fourth direction of extension and sections 115 with a fifth direction of extension.

The second and fourth directions of extension essentially coincide with each other, and the third and fifth directions of extension also essentially coincide with each other.

In the embodiment shown in FIG. 1, the second and third directions of extension of the first conductor are essentially perpendicular to each other, with the second direction of extension essentially coinciding with the first conductors first main direction of extension. Due to the meander shape of the embodiment shown in FIG. 1, both the first and the second conductor have one section that points "straight ahead", i.e., in a general direction of the device, and then one section that is perpendicular to the general direction of the device. Both conductors have alternating such sections, which is what causes the meander shape of the conductors in this embodiment.

As mentioned previously, and as also shown in FIG. 2, there is a capacitive coupling between the two conductors of the device.

Figure 3:
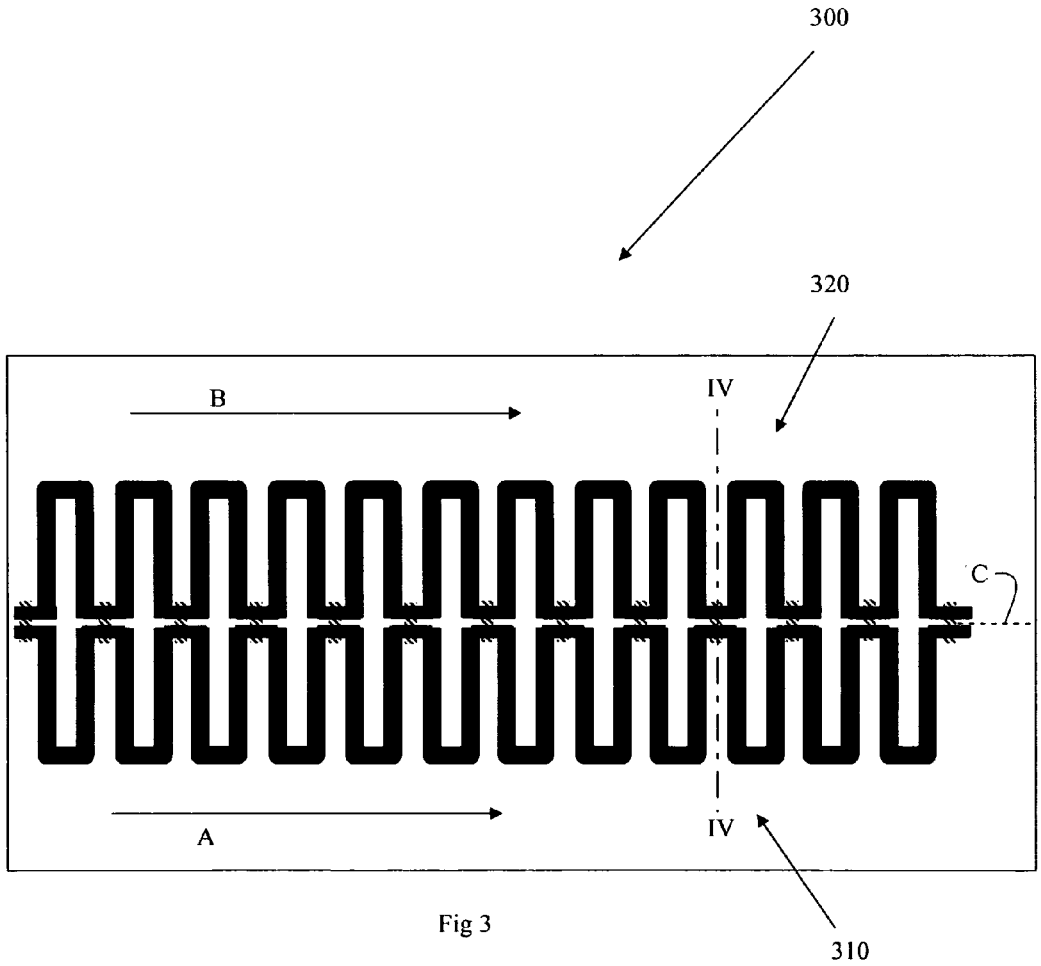
FIG. 3 shows a top view of a second non-limiting example embodiment.

Another example embodiment 300 shown in FIG. 3 enables more flexibility in terms of tailoring the impedance of the device. The device 100 of FIGS. 1 and 2 comprises inductors in the form of the meander lines, but only has capacitive coupling between the meander lines. The embodiment 300 includes capacitors, shown with dashed lines in FIG. 3, and in a cross section in FIG. 4, the cross section being along the line IV-IV in FIG. 3.

Figure 4:
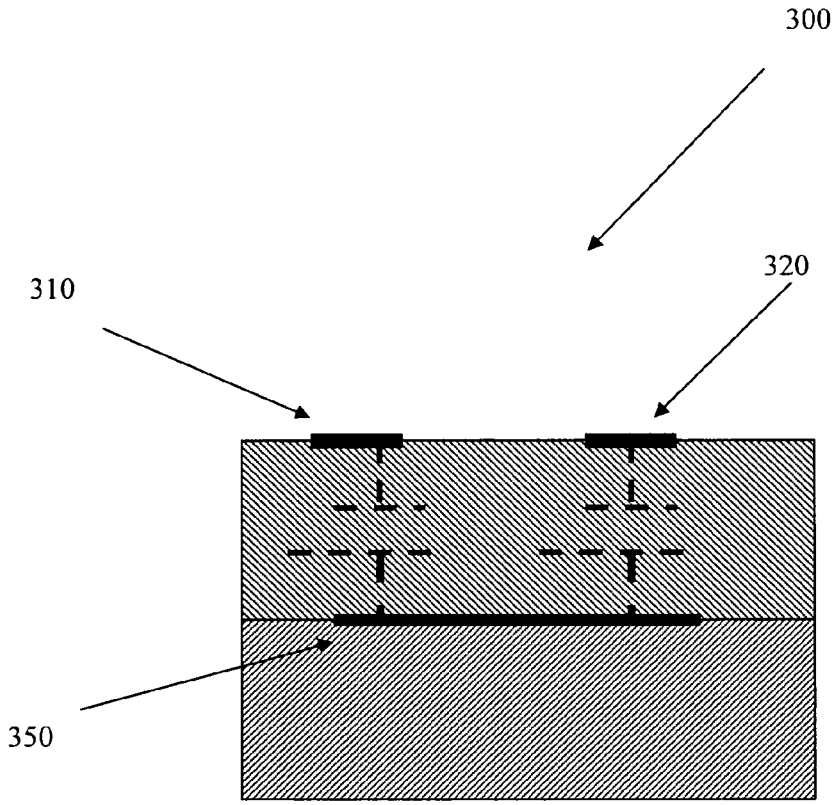
FIG. 4 shows a cross section of the device of FIG. 3, along the line IV-IV.

As shown in FIGS. 3 and 4, the embodiment 300 comprises the same meander shaped first conductor 310 and second conductor 320 conductors and imaginary line C as the embodiment 100 in FIGS. 1 and 2. However, the embodiment 300 additionally comprises a third conductor 350 (see FIG. 4) arranged between the non-conducting substrate and the layer of ferroelectric material, with the third conductor being arranged so that it extends from a point below the first conductor to a point below the second conductor, in a direction of extension which is essentially perpendicular to said first and second directions of extension.

Preferably, the third conductor 350 is arranged below the first 310 and second 320 conductors at a point below sections of the first and second conductors that point in the general direction A/B (see FIG. 3) of the device 300, the third conductor then being arranged so that it "connects" the first and second conductors, the word "connect" here being used in the sense that at least a first part of the third conductor is located below the first conductor, and at least a second part of the third conductor is located below the second conductor. Thus, capacitors are formed between the first and second conductor respectively, and the third conductor.

Suitably, such third conductors are arranged at all or most of those locations on the device 300 which fulfill the conditions stated above for the location of the third conductor 350. Thus, the device 300 includes a plurality of such conductors, all located at corresponding places in the device 300.

Tuning of the delay of the delay line 300 is accomplished by applying a DC-voltage between the first conductor 310 and the second conductor 320 conductors, as shown in FIG. 4. The polarity of the DC voltage as applied to the first 310 and second 320 conductors is denoted with (+) and (−) symbols.

Figure 5A:
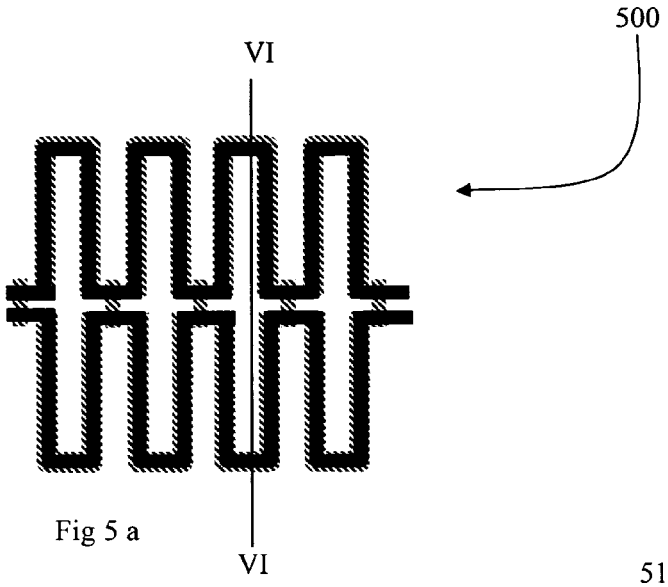
FIGS. 5*a*, 5*b*, and 5*c* show a top view of another non-limiting example embodiment.
Figure 5B:
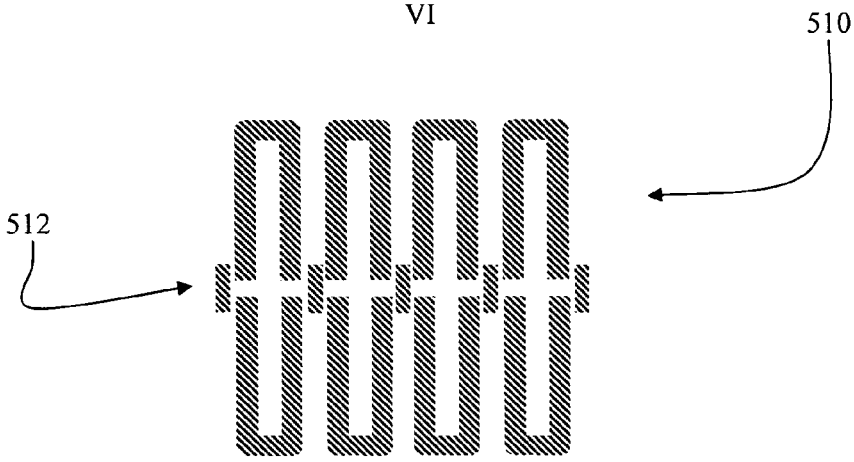
Figure 5C:
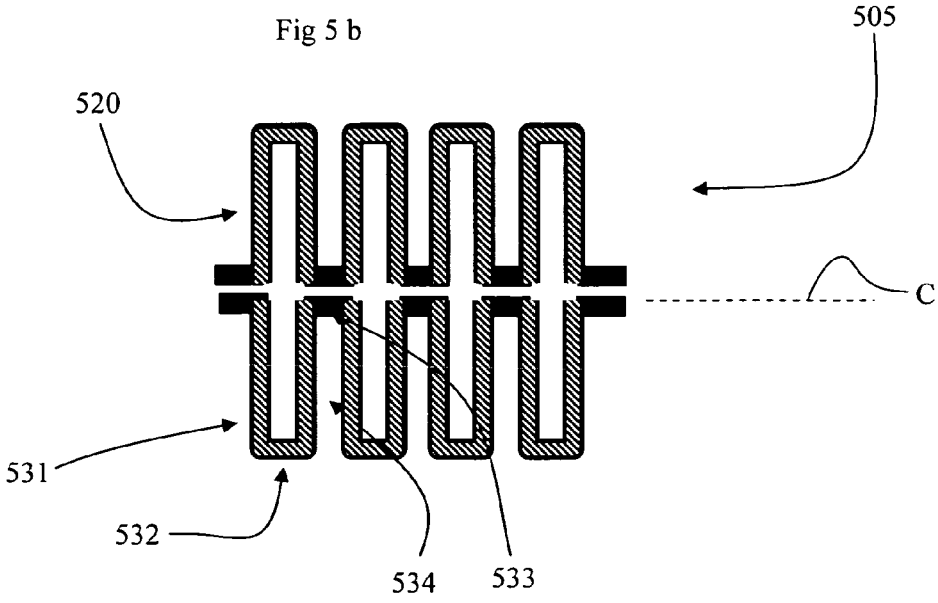

Yet a further example embodiment 500 of a device is shown in FIGS. 5*a*-5*c*. This embodiment shows a way of decreasing the ohmic losses. A first conducting pattern, a first delay line 505, shown in FIG. 5*c*, is formed in the bottom layer of the device, i.e. between a substrate and a ferroelectric material, the first delay line 505 being essentially similar to those shown in FIGS. 1 and 3, i.e. it has two meander shaped conductors 510, 520, essentially parallel to each other, extending in a common general direction, where the conductors are essentially each other's mirror image with respect to an imaginary line C between them, the imaginary line extending in the general direction of the device.

Thus, the two conductors of the delay line 505 have one section 532 that points "straight ahead", i.e. in the general direction of the device, and then one section 531 that is perpendicular to the general direction C of the device 500. Both conductors 510, 520, have alternating such sections, each section being joined to the next one. Thus, each conductor has a recurring pattern of two parallel sections 531, 534, that point "outwards" with respect to the general direction of the device, with the two parallel sections being joined at the "outer" edge of the device by a conductor 532 which is perpendicular to the two parallel sections. Each of the two parallel sections 531, 534, is then joined at its other end, the "inner end" of the meander pattern, to an adjoining such section by a joining conductor 533 shown in FIG. 5*c*, which is again perpendicular to the direction of the parallel sections.

Figure 6:
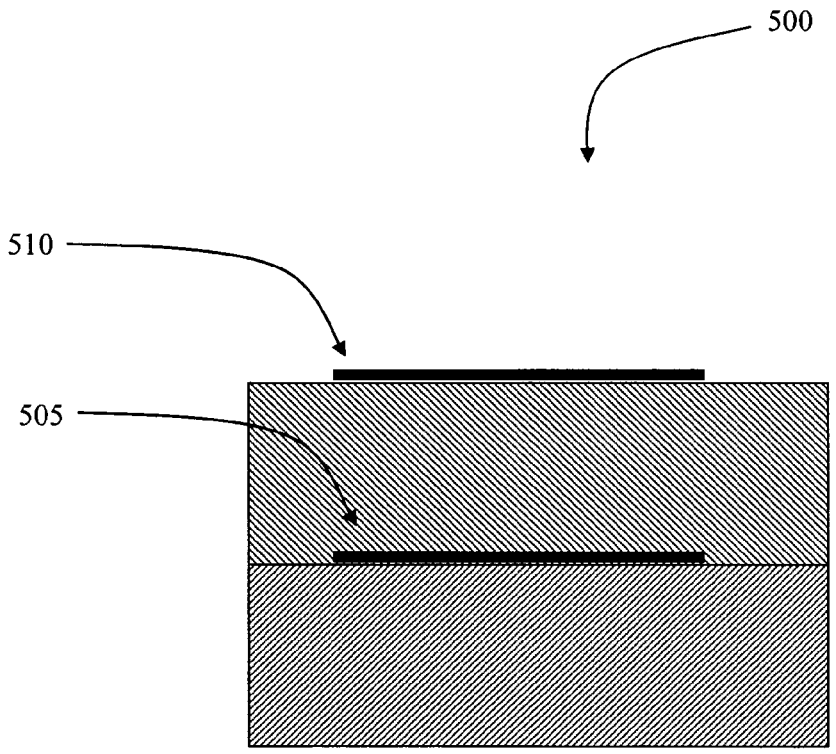
FIG. 6 shows a cross section of the device of FIG. 5, along the line VI-VI.

As shown in FIG. 6, which is a cross section of the device of FIG. 5*a* along the line VI-VI, the device 500 also comprises a second conducting pattern, 510 arranged on top of the ferroelectric layer. The second conducting pattern 510 is shown in top view in FIG. 5*b*. The second conducting pattern 510 is similar to the first conducting pattern 505, with the exception that it does not exhibit the joining conductors 533 at the "inner end".

In the device 500, the first and second conducting patterns are arranged so that corresponding sections "cover" each other, resulting in the device shown in FIG. 5*a*. As can be seen in FIG. 5*b*, the second conducting pattern 510 also exhibits conducting strips 512 which "connect" the joining strips of at the "inner edge" of the first conducting pattern, i.e. the connecting strips 512 in the second conducting pastern extend in a direction perpendicular to the general direction of the device, so as to cover or connect one connecting strip in each meander line of the first conducting pattern.

In the delay lines shown in FIGS. 1-4, 5*a*-5*c*, and 6, there is a certain amount of mutual negative coupling between the inductor strips, i.e., the meander lines, which reduces the total inductance of the device, and thus negatively, influences the delay time of the devices.

Figure 7:
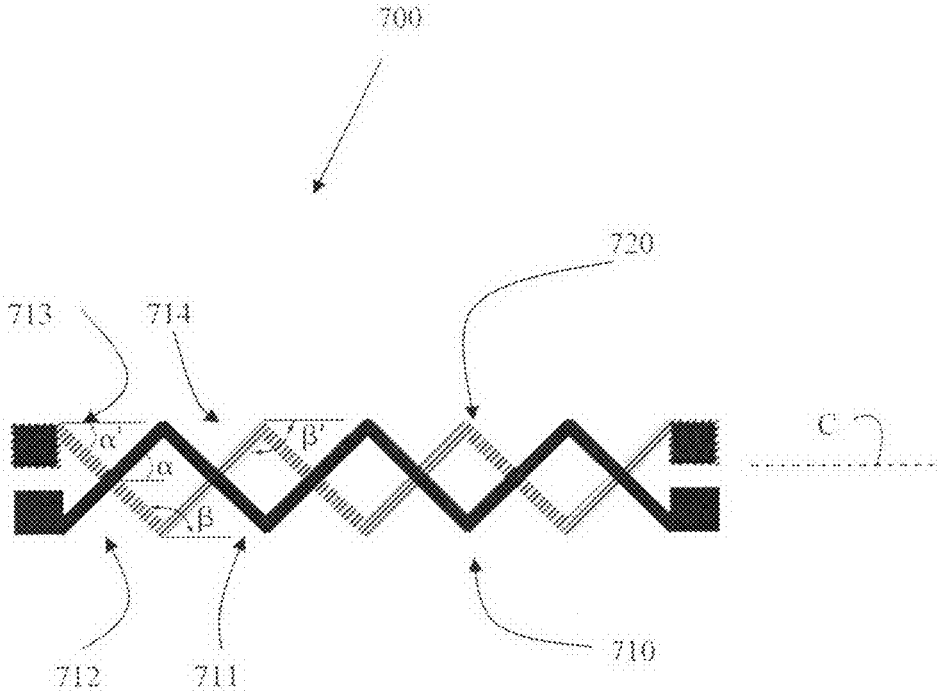
FIG. 7 shows a top view of a non-limiting example embodiment which alleviates mutual negative coupling between conductive strips.

FIG. 7 shows an example embodiment 700 which alleviates the problem of mutual negative coupling between the strips. The device comprises a first conducting pattern 710 and a second 720 conducting pattern arranged on different sides of the ferroelectric layer. Each of the conducting patterns alternatingly comprises sections arranged at 45 degrees or negative 45 degrees, with respect to the general direction C of the device. However, if the first section 712 of the first conductor is arranged at 45 degrees, the first section 713 of the second conductor will be arranged at negative 45 degrees, the two conductors being arranged so that sections which point in different directions intersect each other. Due to the geometry of this, the sections will intersect each other at an angle of 90 degrees, which will essentially eliminate the negative magnetic coupling between the strips.

In a more generalized sense, the embodiment shown in FIG. 7 could be described in the following way. The first conductor 710 alternatingly comprises sections 712 of a second direction of extension and sections 711 of a third direction of extension, with the second direction of extension being at an angle $\alpha$ with respect to the device's main direction C of extension and the third direction of extension being at an angle $\beta$ with respect to the device's main direction C of extension, $\alpha$ being in the interval between zero and ninety degrees, and $\beta$ being in the interval between ninety and one hundred eighty degrees.

The second conductor 720 also comprises sections 713 of a fourth direction of extension and sections 714 of a fifth direction of extension, with the fourth direction of extension being at an angle $\alpha'$ with respect to the device's main direction C of extension and the fifth direction of extension being at an angle $\beta'$ with respect to the device's main direction C of extension, $\alpha'$ being in the interval between zero and minus ninety degrees, and β' being in the interval between minus ninety and minus one hundred eighty degrees.

The first conductor 710 and second conductor 720 are arranged in the delay line 700 so that the first conductor's sections 712 in the second direction of extension cross the second conductor's sections 713 in the fourth direction of extension, and so that the first conductor's sections 711 in the third direction of extension cross the second conductor's sections 714 in the fifth direction of extension.

Figure 8:
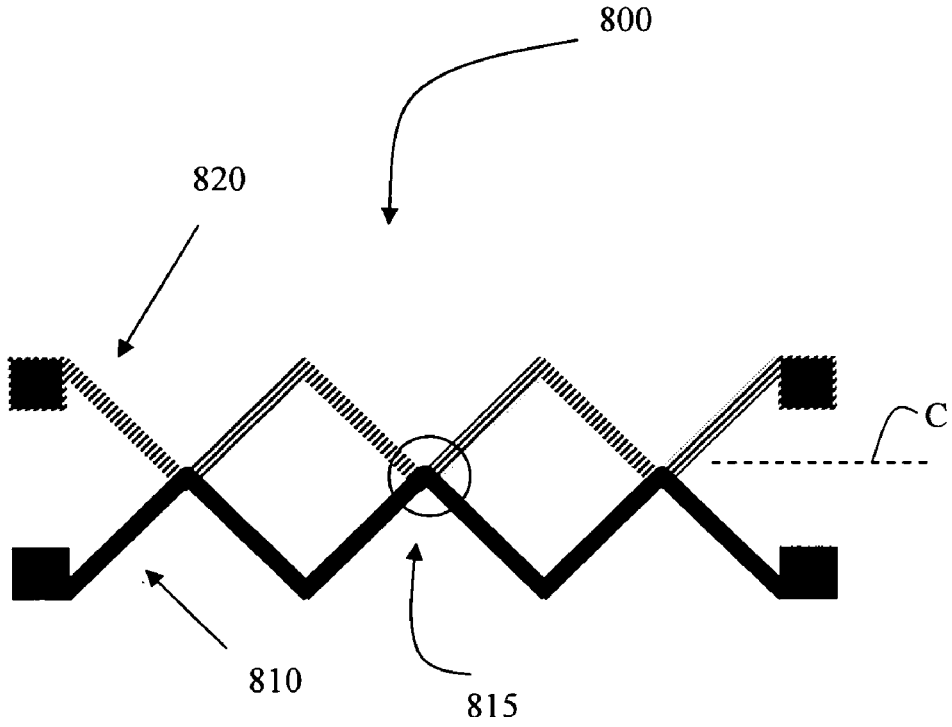
FIG. 8 illustrates a top view of another non-limiting example embodiment.

FIG. 8 shows a version 800 of the device of FIG. 7. In this embodiment, the sections of the two strips 810, 820, do not intersect each other. Rather, they will only coincide or "cover each other" in their respective layers at those points where two adjacent sections in each conductor are joined to each other. One such point 815 has been encircled in FIG. 8 for the sake of clarity.

Figure 9:
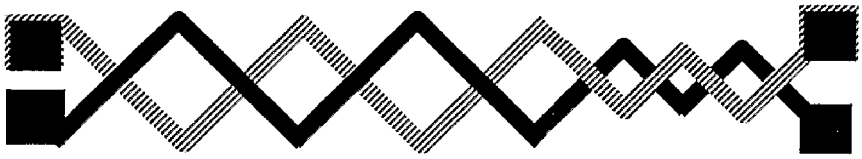
FIG. 9 illustrates a top view of vet another non-limiting example embodiment that achieves better wideband properties as compared to the example embodiment in FIG. 7.

The embodiments which have been shown in FIGS. 1-4, 5*a*-5*c*, 6-8, and described above exhibit excellent properties with respect to wideband applications. FIG. 9 shows a way of achieving even better wideband properties. The basic design of FIG. 7 is adhered to, but the width of the device is tapered.

Figure 10:
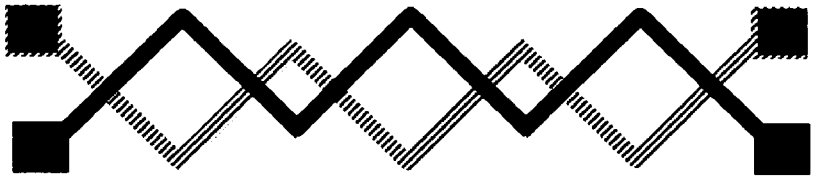
FIG. 10 illustrates a top view of another example non-limiting embodiment with a periodic taper.

As an alternative to tapering the device as shown in FIG. 9, as shown in FIG. 10, the device can periodically taper and then widen again, in the same dimension that it tapered.

Figures 11A, 11B:
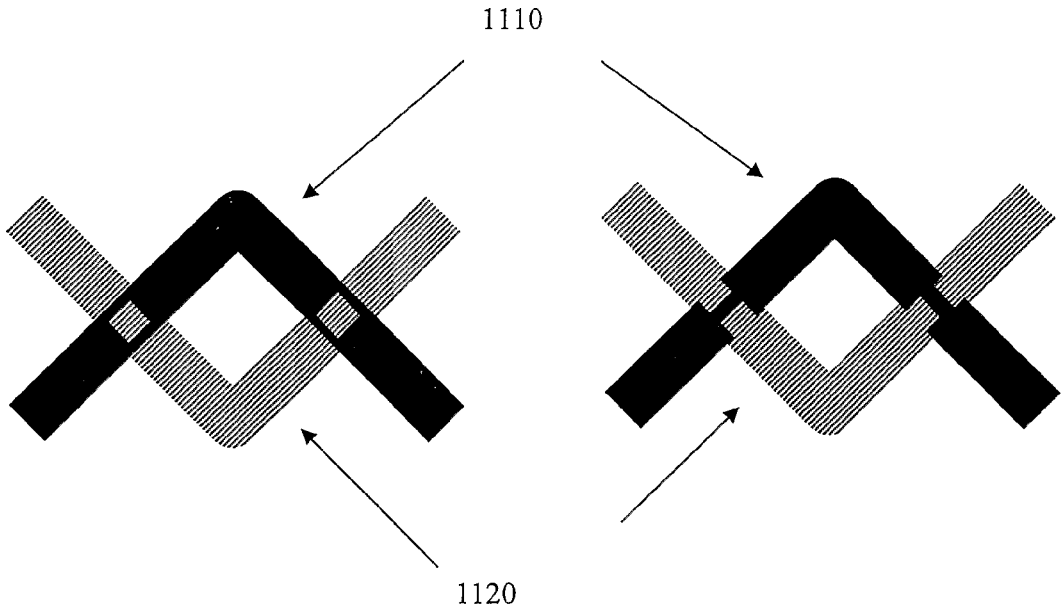
FIGS. 11*a* and 11*b* are top views of non-limiting example embodiments which allow better possibilities for tailoring the capacitance of the device.

In FIGS. 11*a* and 11*b*, variants are shown which allow better possibilities of tailoring the capacitance of the device. There are still two conducting lines 1110, 1120, which are located on either side of a ferroelectric layer supported by a non-conducting substrate, and the lines 1110, 1120, have sections which cross each other, preferably at an angle of 90 degrees, as was also the case in FIG. 7. However, in these variants, where the sections cross each other, one of the sections is altered, to either have an aperture, preferably shaped as a square, or exhibits a significantly much narrower width during all or most of the crossing.

Figure 12A:
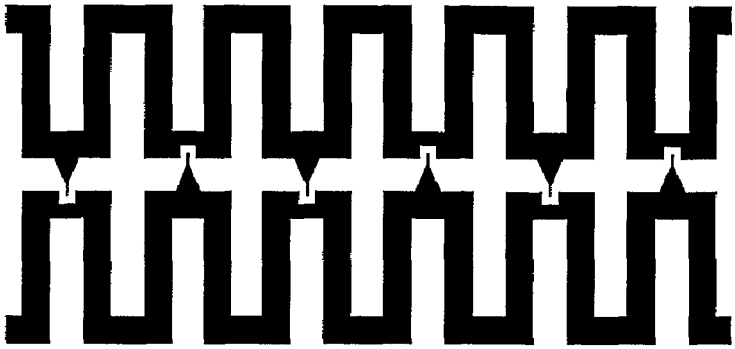
FIGS. 12*a*-12*c* show top views for another non-limiting example embodiment.
Figure 12B:
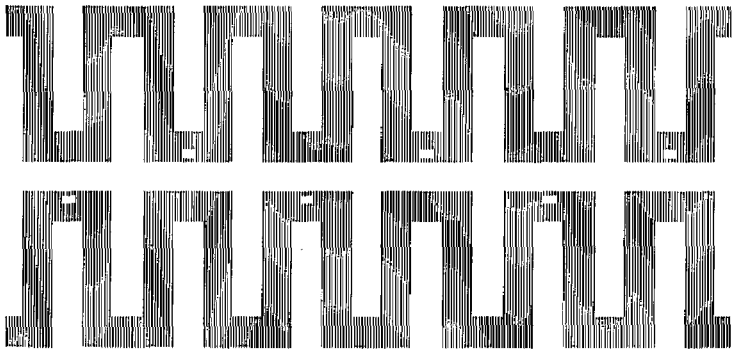
Figure 12C:
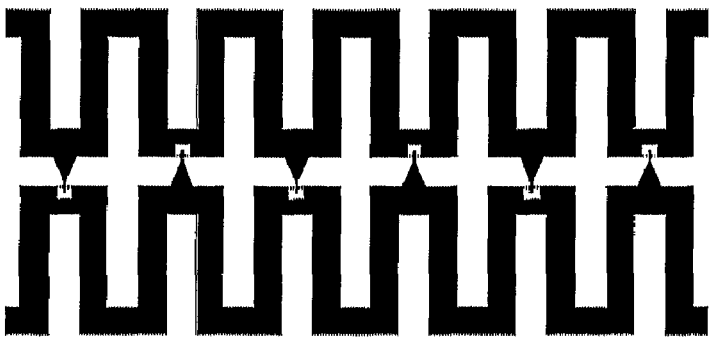

FIGS. 12*a* and 12*b* show top views of components in another example embodiment 1200, and FIG. 12*c* shows the embodiment 1200 as a whole in a top view. This embodiment may give even further reduced losses and increased process tolerances, and uses a capacitance which reduces the required bias voltage, at the same time as it eliminates the floating ground in the middle.

FIG. 12*a* shows the bottom layer, and FIG. 12*b* shows the top layer, both layers being conducting, and separated in the same manner as the conductors in the embodiments shown in FIGS. 7-10, 11*a*, and 11*b*.

The bottom conductor of FIG. 12*a* and the top conductor of FIG. 12*b* are of essentially the same design, and intended to be arranged "on top of each other", with the mentioned separating layers between them, in such a manner that corresponding parts in each conductor "cover" each other. Each conductor comprises two meander shaped conducting patterns, being arranged to be each other's mirror image with respect to an imaginary line extending in the direction of the conductors, between the conductors. Thus, each of the meander patterns will have sections parallel to each other which extend perpendicularly to the general direction of extension of the conductor, and sections parallel to each other which have a direction of extension that coincides with the general direction of extension of the conductor, the two kinds of sections alternating in the meander pattern. Thus, in each meander line, of those sections which have a direction of extension that coincides with the general direction of extension of the conductor, there will be sections that are closest to the other meander line, and such sections which are the most distant from the other meander line.

In order to achieve the desired capacitive coupling, in the bottom conductor, every other such "closest" section comprises a protrusion towards the other meander line, the protrusion ending in a thin line, and every other closest section comprises a recess allowing for a slight "intrusion" of the thin line.

In the top conductor, the "closest" sections corresponding to those closest sections in the bottom conductor which have the recess comprise a square or rectangular aperture which will "enclose" the intruding part of the thin line, although in an other plane of the device, this will enhance the production tolerance of the device.

The invention claimed is:

1. A tunable electromagnetic delay line, comprising:

a first conductor with a first main direction of extension, said first conductor being arranged on top of a non-conducting substrate, a layer of a ferroelectric material with first and second main surfaces, said layer separates the first conductor and the substrate, and a second conductor with a second main direction of extension, with the first and second main directions of extensions essentially coinciding with each other, and with the first and second conductors being mirror images with respect to an imaginary line in the center of the delay line along said first and second main directions of extension, said tuning being accomplished by applying a voltage between said first and second conductors, wherein the first conductor alternatingly comprises sections with a second direction of extension and sections with a third direction of extension, and with the second conductor alternatingly comprising sections with a fourth direction of extension and sections with a fifth direction of extension, where said second and fourth directions of extensions essentially coincide with each other, and said third and fifth directions of extensions essentially coincide with each other.

2. The tunable delay line of claim 1, additionally comprising a third conductor arranged between the substrate and the layer of ferroelectric material, said third conductor being arranged so that the third conductor extends from a point below the first conductor to a point below the second conductor, in a direction of extension which is essentially perpendicular to said first and second directions of extension.

3. A tunable electromagnetic delay line, comprising:

a first conductor with a first main direction of extension, said first conductor being arranged on top of a non-conducting substrate, a layer of a ferroelectric material with first and second main surfaces, said layer separates the first conductor and the substrate, and a second conductor with a second main direction of extension, with the first and second main directions of extensions essentially coinciding with each other, and with the first and second conductors being mirror images with respect to an imaginary line in the center of the delay line along said first and second main directions of extension, said tuning being accomplished by applying a voltage between said first and second conductors, wherein the first conductor alternatingly comprises sections with a second direction of extension and sections with a third direction of extension, and with the second conductor alternatingly comprising sections with a fourth direction of extension and sections with a fifth direction of extension, where said second and fourth directions of extensions essentially coincide with each other, and said third and fifth directions of extensions essentially coincide with each other, and wherein the second conductor is arranged between the ferroelectric layer and the substrate, so that the first and second conductors are on opposite sides with respect to the main surfaces of the ferroelectric layer.

4. The tunable delay line of claim 3, in which the first and second conductors are arranged in the delay line so that locations where sections of the first conductor in the second and third directions of extension meet overlap locations in the second conductor where sections of the second conductor in the third and fourth direction of extension meet.

5. The tunable delay line of claim 3, in which the second direction of the first conductor of extension is at an angle $\alpha$ with respect to the first main direction of extension and the third direction of the first conductor extension is at an angle $\beta$ with respect to the first main direction of extension, $\alpha$ being in the interval between zero and ninety degrees, and $\beta$ being in the interval between ninety and one hundred eighty degrees.

6. The tunable delay line of claim 3, in which the first and second conductors are arranged in the delay line so that sections of the first conductor in the second direction of extension cross sections of the second conductor in the fourth direction of extension, and so that sections of the first conductor in the third direction of extension cross sections of the second conductor in the fifth direction of extension.

* * * * *